US006149539A

United States Patent [19]

DeMarini

[11] Patent Number: 6,149,539

[45] **Date of Patent: *Nov. 21, 2000**

[54] LONG LIFE BAT

[75] Inventor: Raymond Vincent DeMarini, Beaverton, Oreg.

[73] Assignee: DeMarini Sports, Inc., Hillsboro, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 08/904,899

[22] Filed: Aug. 1, 1997

[51] Int. Cl.[7] ..... A63B 59/06

[52] U.S. Cl. ..... 473/564; 473/457

[58] Field of Search ..... 473/564, 566, 473/457, 567, 568, FOR 169, FOR 170, FOR 105; D21/211

[56] References Cited

U.S. PATENT DOCUMENTS

| | | | |
|---|---|---|---|
| D. 347,671 | 6/1994 | Weiss et al. | D21/211 |
| 727,359 | 5/1903 | Held | 473/564 |
| 1,121,189 | 12/1914 | Lincoln | 473/564 |
| 2,944,820 | 7/1960 | Paullus | 473/564 |
| 4,644,630 | 2/1987 | Blum | 473/567 |
| 5,284,332 | 2/1994 | DiTullio | 473/564 |
| 5,303,917 | 4/1994 | Uke | 473/564 |
| 5,516,097 | 5/1996 | Huddleston | 473/457 |

OTHER PUBLICATIONS

Hillerich & Bradsby (Hillerich) bat advertisement, The Sporting Goods Dealer, p. 338, Jan. 1978.

*Primary Examiner*—Mark S. Graham
*Attorney, Agent, or Firm*—Gardere & Wynne, L.L.P.

[57] ABSTRACT

A long life softball bat comprising a bat and a plurality of positional reference marks is disclosed and claimed. The positional reference marks provide a frame of reference which enables a user of the bat to distribute the impact force of a batted ball about the surface of said bat.

12 Claims, 1 Drawing Sheet

LONG LIFE BAT

This application claims priority of U.S. patent application Ser. No. 08/901,944, filed Jul. 29, 1997, abandoned.

BACKGROUND OF THE INVENTION

1. Field of the Invention

This invention relates to the field of softball and baseball bats and more particularly relates to design changes made to said bats to increase their useful life.

2. Description of Related Art

Tubular metallic and wooden softball and baseball bats are well known to the art. A common example is the tubular aluminum bat. Such bats have the advantage of a generally good impact response, meaning that the bat effectively transfers power to a batted ball. This effective power transfer results in ball players achieving good "slugging" distances with batted balls.

Even though today's aluminum bats perform well, there is an ever—continuing quest for bats with better overall slugging capacity. Many of the design efforts to date have focused upon the materials, components and geometric shape (exterior and interior) of the bat. A fine example of such an effort is U.S. Pat. No. 5,415,398 (May 16, 1995), entitled "Softball Bat," to Michael D. Eggiman. This patent discloses an extremely high-performance tubular aluminum bat featuring a specially designed tubular aluminum insert.

Even though these efforts have conferred a terrific benefit upon the bat—making art (and the public), it is believed that relatively little effort has been devoted to a related problem which also undermines the bat's (and, therefore, the ball player's) overall performance. That problem is the problem of soft spots, or localized areas of weak or eroded material strength, developing in particular portions of the hitting portion of the bat.

The reason soft spots occur is easy enough to understand. Many, if not all, bats feature a manufacturer's logo or trademark on some portion of the surface of the bat. These logos invariably are not symmetrically placed around the circumference of the bat; rather, they present their appearance predominantly on one side (at one location) of the bat. Human nature being what it is, the ball player will frequently, out of simple habit, grasp the bat, adopt his hitting stance, and prepare to swing, with the bat in hand in the same position each time. The result is obvious enough: each time he hits the ball (whether fair or foul), the ball strikes the same portion of the bat.

When the ball strikes the same relatively small portion of the bat's hitting surface time and time again, it is believed that the material in that area of the bat slowly weakens. Eventually, over time, the aluminum bat will dent; the wooden bat will crack. Both occurrences are likely premature.

The cost to the ball player (and his team) of this phenomenon is clear. The "spring", or rebound (or, more technically speaking, the impact response), of the bat erodes more and more over the useful life of the bat. Furthermore, the bat wears out (e.g., dents or cracks) prematurely, forcing the player to incur the cost of a new bat sooner than would otherwise be the case.

What is needed is a design for a bat which will maximize the lifetime performance of the bat, regardless of its material of construction, its components, or its geometric shape (exterior or interior). Specifically, what is needed is a bat design which ensures that (or at least increases the probability that) the force of the ball impact will be distributed evenly about the bat throughout its useful life.

SUMMARY OF THE INVENTION

Conventional softball and baseball bats feature a relatively common design. They feature a large diameter impact portion, an intermediate tapering portion, and a relatively small diameter handle portion. Most bats also feature an end portion and a handle cap.

What is unconventional about the softball bat of the present invention is that it is fitted with positional reference marks which are placed about the surface of the bat.

The utility of the positional reference marks is that the marks provide a frame of reference which enables the softball player to distribute the impact force of the batted ball around the entire surface of the bat. Each time a batter hits a ball, he rotates the bat to a new radial location, ensuring that a hard spot strikes the ball each time and that the bat enjoys the longest life possible.

The term "positional reference marks" is intended to encompass not only numeric markings, but, in addition, markings which are equivalent, such as alphabetic characters, colors, card suits, symbols, or other shapes. Braille indentations would also serve. While the inventor has found that eight positional reference marks are convenient and effective, it is also possible to derive the benefit of the invention by using two, three, four, five, six, seven, nine, or some other number of markings. The key is to distribute the work of the bat throughout the bat. The result is increased average hitting power and longer bat life.

DETAILED DESCRIPTION

Figure 1:
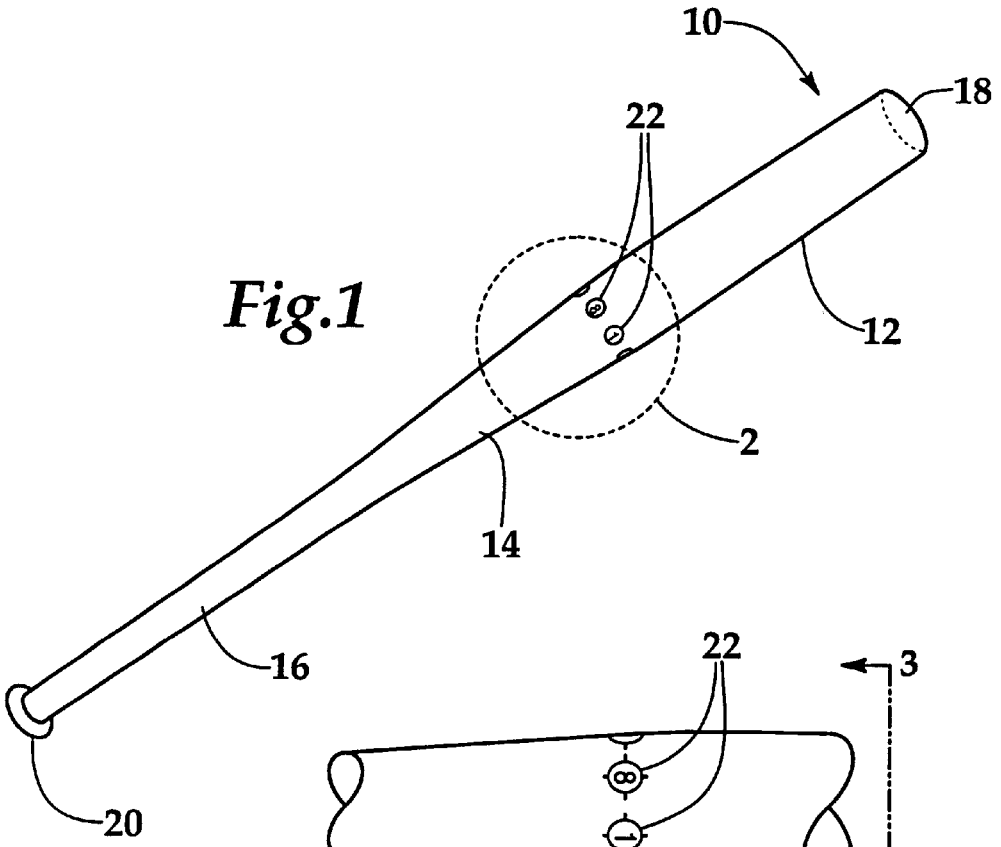
FIG. 1 is an isometric view of the invention, a long life softball bat.

Referring to FIG. 1, a novel, long life softball (or baseball) bat 10 is shown. Although the bat 10 is frequently referred to as a softball bat in this application, the bat 10 might also be a baseball bat, and the term "bat" is specifically intended to encompass both softball bats and baseball bats.

As is conventional, the bat 10 features a relatively large diameter impact portion 12, an intermediate tapering portion 14, and a relatively small diameter handle portion 16. The bat also features an end portion 18 and a handle cap 20. All of these portions of the bat 10 are well known to the art.

What is unconventional about said bat 10 are the positional reference marks 22 which, in FIG. 1, are placed about the cylindrical surface of the impact portion 12 of the bat 10. These positional reference marks 22 appear somewhat indistinctly in FIG. 1 and much more prominently and readably in the section magnification of FIG. 1 which appears in FIG. 2.

Figure 2:
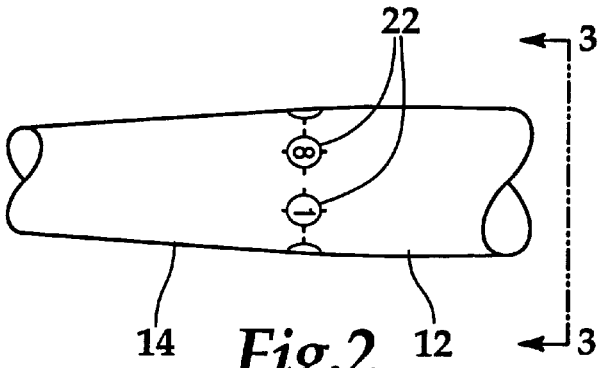
FIG. 2 is a close up side view of the invention, clearly revealing the positional reference marks of the invention. The FIG. 2 view of the positional reference marks is a magnification of the marks appearing indistinctly in FIG. 1.

The positional reference marks 22 may be spaced about the impact portion 12 of the bat, the tapering portion 14, the handle portion 16, the end cap 18, or the handle cap 20 of the bat. However, it is convenient and effective to place them about the impact portion 12 of the bat, where they are highly visible. It is this placement of the positional reference marks 22 that is shown in FIGS. 1 and 2.

Figure 3:
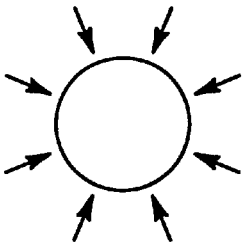
FIG. 3 is a cross-sectional end view of the invention, taken along the line 3—3 of FIG. 2, depicting the physical location of the positional reference marks of the invention.

The utility of employing the positional reference marks 22 referenced herein is that these marks provide a frame of reference which enables the softball player to distribute the impact force of the batted ball around the entire surface of the bat. Reference to FIG. 3 reveals that, in the example shown in the drawings, there are eight positional reference marks which are evenly distributed about the entire radial hitting surface of the bat 10. See FIG. 3 (showing the eight radial locations where the positional reference marks of FIGS. 1 and 2 are placed).

By use of a bat 10 so designed, each time a batter hits a foul ball, for example, he may rotate the bat to one of seven new radial locations, ensuring that a hard spot strikes the ball each time and that the bat 10 enjoys the longest life possible. Similarly, during batting practice, each time a batter hits a ball (whether fair or foul), he may again rotate his bat 10, so that the bat 10 is optimally positioned to survive the rigors of the session. It has even been observed that, when an aluminum bat dents, rotation of the bat may result in the dent "popping" out during the occurrence of a subsequent hit.

New bat designs are researched, developed and introduced each day. In the example depicted in the drawings, the positional reference marks 22 are evenly radially distributed about the surface of the bat. See FIG. 3. However, it is also readily conceivable that some bats might feature preferred hitting areas on the bat surface. In such cases, the positional reference marks would be unevenly radially distributed about the surface of the bat. This would reveal itself in an asymmetrical distribution of the reference arrows shown in FIG. 3.

Similarly, the positional reference marks 22 shown in FIG. 2 are distributed about the surface of the bat at a single axial location. That is, the positional reference marks 22 appear at a fixed distance (along the axis of the bat) from the handle cap 20. Distributing the positional reference marks 22 at a plurality of axial locations would distribute the force of the impacted ball along the length of the impact portion 12 of the bat. For example, assuming sequential numeric positional reference marks were used, if even-numbered positional reference marks 22 were placed one inch further away from the handle cap 20 than odd-numbered positional reference marks 22, then the user of the bat would, by adjusting his swing, position, choke, etc., increase the probability that the force of the next impact would be felt at a portion of the impact portion 12 closer to the end portion 18 of the bat 10.

Figure 4:
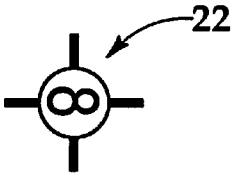
FIG. 4 is a close-up view of a positional reference mark which has been found to be effective.

The term "positional reference marks" is intended to encompass the numeric markings 22 depicted in FIG. 2. However, the term is also intended to encompass markings which are equivalent, such as alphabetic characters, colors, card suits, symbols, or other shapes. A particularly effective positional reference mark that the inventor has employed, and the one recommended for a preferred embodiment, is the circular, targeted positional reference mark 22 shown in FIG. 4.

While eight positional reference marks 22 are used about the circumference of the bat 10 shown in FIGS. 1–3, it would also be possible to derive the benefit of the invention by using two, three, four, five, six, seven, nine, or some other number of markings. Furthermore, when sequential positional reference marks are used, they may be placed so as to induce a variety of radial rotation patterns.

As FIG. 2 suggests, the inventor has found that an effective, and preferred, rotational pattern is incremental, conrotatory rotation of the bat, wherein the user rotates the bat in successive increments in the same direction. In FIGS. 1–3, for example, the user rotates the bat 10 in equal successive increments of one-eighth of its total rotation (12.5 per cent of total rotation, or forty-five degrees) in a clockwise direction (viewed from the end portion 18 of the bat looking towards the handle cap 20 in the distance) each time he strikes a ball. Other rotation patterns would doubtless also be effective. The key, as discussed hereinabove, is to distribute the work of the bat throughout the bat.

While several embodiments of the invention have been shown and described, other variations (which are, in reality, equivalents) will be readily apparent to those of ordinary skill in the art. Thus, the invention is not limited to the embodiments shown and described herein but, rather, is intended to cover all such variations as may be within the scope of the following claims.

What is claimed is:

1. A tubular bat comprising:

tubular member having an outer surface; and at least three distinct symbolic positional reference marks taken from a group of symbols having a recognizable order placed in a predetermined circumferential pattern on said bat, said symbolic positional reference marks providing a rotational frame of reference which facilitates a user of said bat to periodically rotate the bat to a plurality of positions circumferentially correlated to said symbolic positional reference marks to distribute the impact force of a batted ball at different places around the circumference of said bat, said symbolic positional reference marks being placed in a generally orderly manner on said bat in order of increasing value to facilitate establishing incremental rotation of said bat.

2. The tubular bat as recited in claim 1 wherein there are four such distinct symbolic positional reference marks spaced approximately ¼ of the circumference of the bat apart.

3. The tubular bat as recited in claim 1 wherein there are five such distinct symbolic positional reference marks spaced approximately ⅕ of the circumference of the bat apart.

4. The tubular bat as recited in claim 1 wherein there are six such distinct symbolic positional reference marks spaced approximately ⅙ of the circumference of the bat apart.

5. The tubular bat as recited in claim 1 wherein there are seven such distinct symbolic positional reference marks spaced approximately ⅐ of the circumference of the bat apart.

6. The tubular bat as recited in claim 1 wherein there are at least eight such distinct symbolic positional reference marks spaced approximately equally spaced around the circumference of the bat apart.

7. The tubular bat as recited in claim 1 wherein said symbolic positional reference marks are distributed about the surface of the bat at substantially a single axial location.

8. The tubular bat as recited in claim 1 wherein said positional reference marks are distributed about the surface of said bat at a plurality of axial but substantially contiguous locations.

9. The tubular bat as recited in claim 1 wherein said symbolic positional reference marks each include a number between one and n such numbers incrementing from one to n sequentially around the circumference of the bat.

10. The tubular bat as recited in claim 1 wherein said symbolic positional reference marks each include an alphabetic letter and said symbolic positional reference marks are arranged to increment circumferentially in alphabetical order.

11. The tubular bat as recited in claim 9 wherein n is at least three.

12. The tubular bat as recited in claim 11 wherein said symbolic positional reference marks are distributed about the surface of the bat at substantially a single axial location.

* * * * *